US012440739B2

(12) United States Patent
Drosihn

(10) Patent No.: US 12,440,739 B2
(45) Date of Patent: Oct. 14, 2025

(54) TABLE TENNIS COLLECTION SYSTEM

(71) Applicant: Joseph Drosihn, Calistoga, CA (US)

(72) Inventor: Joseph Drosihn, Calistoga, CA (US)

( * ) Notice: Subject to any disclaimer, the term of this patent is extended or adjusted under 35 U.S.C. 154(b) by 753 days.

(21) Appl. No.: 17/841,608

(22) Filed: Jun. 15, 2022

(65) Prior Publication Data

US 2022/0401809 A1 Dec. 22, 2022

Related U.S. Application Data

(60) Provisional application No. 63/211,515, filed on Jun. 16, 2021.

(51) Int. Cl.

| | |
|---|---|
| ***A63B 67/00*** | (2006.01) |
| ***A63B 67/04*** | (2006.01) |
| ***A63B 71/02*** | (2006.01) |
| *A63B 102/16* | (2015.01) |

(52) U.S. Cl.

CPC ..... *A63B 67/04* (2013.01); *A63B 71/022* (2013.01); *A63B 71/023* (2013.01); *A63B 2102/16* (2015.10)

(58) Field of Classification Search

CPC ..... A63B 67/04; A63B 71/022; A63B 71/023; A63B 2102/16; A63B 47/02; A63B 47/025

USPC ..... 473/459–460, 475

See application file for complete search history.

(56) References Cited

U.S. PATENT DOCUMENTS

| | | | | | |
|---|---|---|---|---|---|
| 2,313,701 | A * | 3/1943 | White | A63B 67/04 | 473/475 |
| 3,043,592 | A * | 7/1962 | Lohr | A63B 67/04 | 124/39 |
| 3,410,556 | A * | 11/1968 | Kaiser | A63B 69/40 | 473/436 |
| 3,761,085 | A * | 9/1973 | Cook | A63B 69/406 | 473/436 |
| 3,815,907 | A * | 6/1974 | Cook | A63B 69/40 | 473/436 |
| 3,917,265 | A * | 11/1975 | Schrier | A63B 69/409 | 124/53.5 |
| 3,992,006 | A * | 11/1976 | Barlow | A63B 65/12 | 273/342 |

(Continued)

FOREIGN PATENT DOCUMENTS

| | | | | |
|---|---|---|---|---|
| BE | 1009387 A6 * | 3/1997 | ..... | A47B 25/003 |
| CA | 2952516 A1 * | 6/2018 | | |

(Continued)

*Primary Examiner* — Kiley S Stoner

(74) *Attorney, Agent, or Firm* — Sandy Lipkin

(57) ABSTRACT

A table tennis collection system is provided. The system may utilize a collection element having a horizontally elongate shape with a first end and an opposing second end. The collection element may have a first net element extending from the first end to the second end. The system may further utilize a first collection pocket disposed at the first end and a second collection pocket disposed at the second end. The first collection pocket may have a second net element and the second collection pocket may have a third net element. The system may further utilize a first support element disposed between the first collection pocket and the collection element at the first end and a second support element disposed between the second collection pocket and the collection element at the second end.

18 Claims, 9 Drawing Sheets

(56) References Cited

U.S. PATENT DOCUMENTS

| | | | | | |
|---|---|---|---|---|---|
| 3,999,754 | A * | 12/1976 | Krzysztofiak | A63B 69/409 | 124/56 |
| 4,034,978 | A * | 7/1977 | Becker | A63B 67/04 | 473/416 |
| 4,875,678 | A * | 10/1989 | Sawyer | A63B 47/025 | 473/475 |
| 5,566,936 | A * | 10/1996 | Newgarden | A63B 63/007 | 473/475 |
| 6,186,132 | B1 * | 2/2001 | Ko | A63B 69/40 | 473/460 |
| 6,371,872 | B1 * | 4/2002 | Daley | A63B 69/406 | 473/460 |
| 6,416,431 | B1 * | 7/2002 | Keehn, Sr. | A63B 71/022 | 473/472 |
| 11,826,623 | B2 * | 11/2023 | Burns, III | A63B 61/02 | |
| 2004/0242351 | A1 * | 12/2004 | Lu | A63B 67/04 | 473/459 |
| 2005/0159251 | A1 * | 7/2005 | Houston | A63F 7/34 | 473/459 |
| 2012/0071278 | A1 * | 3/2012 | Mansfield | A63B 71/022 | 473/421 |
| 2012/0329581 | A1 * | 12/2012 | Chen | A63F 7/0636 | 473/416 |
| 2018/0050240 | A1 * | 2/2018 | Kettler | A63B 47/02 | |
| 2018/0369629 | A1 * | 12/2018 | Publicover | A63B 5/11 | |
| 2023/0338783 | A1 * | 10/2023 | Sorensen | A63B 47/025 | |

FOREIGN PATENT DOCUMENTS

| | | | | | |
|---|---|---|---|---|---|
| CN | 1085460 | A * | 4/1994 | A63B 67/04 | |
| CN | 105709389 | A * | 6/2016 | A63B 47/025 | |
| CN | 105749517 | A * | 7/2016 | A47B 25/003 | |
| CN | 106606853 | A * | 5/2017 | | |
| CN | 108042996 | A * | 5/2018 | A63B 47/025 | |
| CN | 108310733 | A * | 7/2018 | A63B 47/024 | |
| CN | 108479035 | A * | 9/2018 | A47B 25/003 | |
| CN | 110159013 | A * | 8/2019 | | |
| CN | 111282224 | A * | 6/2020 | | |
| CN | 111840939 | A * | 10/2020 | | |
| CN | 112973062 | A * | 6/2021 | | |
| CN | 113786598 | A * | 12/2021 | | |
| CN | 113893509 | A * | 1/2022 | A63B 47/025 | |
| CN | 114470692 | A * | 5/2022 | | |
| CN | 114849196 | A * | 8/2022 | | |
| CN | 115155023 | A * | 10/2022 | | |
| CN | 115155024 | A * | 10/2022 | | |
| DE | 3133551 | A * | 3/1983 | A63B 47/025 | |
| DE | 29622337 | U1 * | 3/1997 | A63B 67/04 | |
| DE | 3405902 | C2 * | 11/1997 | A63B 69/406 | |
| DE | 19925153 | A1 * | 12/2000 | A63B 67/04 | |
| DE | 20309227 | U1 * | 8/2003 | A63B 47/025 | |
| DE | 202004018675 | U1 * | 3/2005 | A63B 69/40 | |
| EP | 0094267 | B1 * | 3/1986 | | |
| EP | 0903166 | A2 * | 3/1999 | | |
| ES | 2251870 | A1 * | 5/2006 | A47B 25/003 | |
| FR | 2776935 | A1 * | 10/1999 | A63B 67/04 | |
| GB | 857260 | A * | 12/1960 | | |
| GB | 2193440 | A * | 2/1988 | A63B 67/04 | |
| JP | 06134057 | A * | 5/1994 | | |
| JP | H06134057 | A * | 5/1994 | | |
| KR | 200401471 | Y1 * | 11/2005 | | |
| KR | 200402949 | Y1 * | 12/2005 | | |
| KR | 20110087063 | A * | 8/2011 | | |
| KR | 101236304 | B1 * | 2/2013 | | |
| KR | 20170016667 | A * | 2/2017 | | |
| KR | 20190013194 | A * | 2/2019 | | |
| KR | 20200002454 | U * | 11/2020 | | |
| KR | 200493946 | Y1 * | 7/2021 | | |
| WO | WO-8605701 | A1 * | 12/1986 | | |
| WO | WO-9408666 | A1 * | 4/1994 | A63B 67/04 | |

* cited by examiner

TABLE TENNIS COLLECTION SYSTEM

CROSS-REFERENCE TO RELATED APPLICATIONS

This application claims priority to U.S. Provisional Patent Application Ser. No. 63/211,515, entitled "Table Tennis Collection System," filed Jun. 16, 2021. The contents of this application are hereby incorporated by reference in their entirety.

BACKGROUND OF THE INVENTION

Table tennis is a sport that is estimated to have hundreds of millions of players worldwide. These players range from school-aged children to adults. Many schools and other organizations have chosen to include table tennis in their operations as a recreational activity. Additionally, there are many adults who make a career as a professional table tennis player. In fact, high-level participation in the sport has also grown over the years with high-stakes competitions taking place worldwide.

There are few limitations to playing table tennis for the general populous. Assuming the physical equipment for table tennis can be sourced, the only limitations to playing table tennis are mobility-related. While the act of playing table tennis is not physically rigorous, the act of retrieving the table tennis balls is significantly more physically rigorous, particularly for the young, the elderly and the physically-impaired players of table tennis. One object of the present invention is to reduce the limitations to playing table tennis for all players.

The game of table tennis involves a ball being hit back and forth across a table. Often, when a player misses the ball or a return shot misses the table, the ball leaves the table and may bounce far away from the playing table and may roll into small spaces under large furniture or the like. The ball needs to be recovered by a player or a bystander before gameplay can resume. This frequent occurrence adds considerable time to the overall match and interrupts the flow of the game. Further, a loose ball may easily be damaged if someone accidentally steps on the ball. Therefore, it is another object of the present invention to reduce the occurrences of loose and/or lost balls that stray from the playing table during gameplay. Further, it is another object of the present invention to make the process of stray ball retrieval easier for all ages of table tennis players.

There is a need for a way to improve table tennis gameplay. Providing a means for reducing delays in gameplay will reduce the overall duration of the game. This can allow a smoother flow to the gameplay without interrupting the player's focus on the game and their opponent. Further, by reducing the length of gameplay, the limitations to gameplay for the young, the elderly and the physically-impaired players of table tennis will be reduced.

Further, reducing delays will provide greater enjoyment of table tennis to the players. Requiring less time to be spent on non-gameplay activities will improve the player's focus on the competition, which may raise the level of competition. This can make gameplay faster paced and more exciting which may make table tennis more enjoyable for bystanders or spectators as well, thereby increasing the marketability of table tennis as a sport overall.

DETAILED DESCRIPTION OF THE INVENTION

Figure 1A:
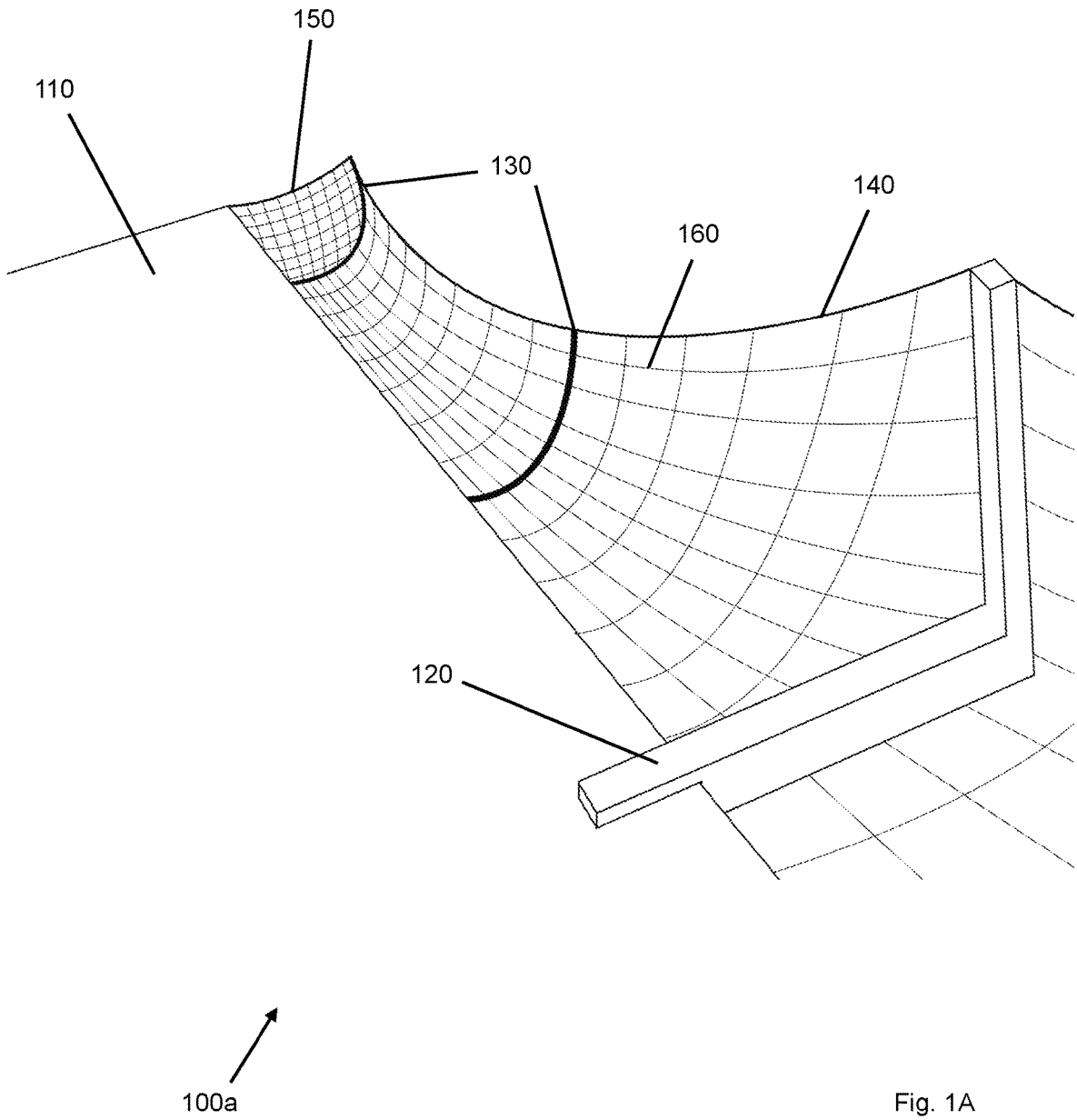
FIG. 1A illustrates a perspective view of a table tennis collection system in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a table tennis collection system" also includes a plurality of table tennis collection systems and the like.

In some embodiments, a table tennis collection system is provided comprising a collection element having a horizontally elongate shape with a first end and an opposing second end, wherein the collection element comprises a first net element extending from the first end to the second end; a first collection pocket disposed at the first end and a second collection pocket disposed at the second end, wherein the first collection pocket comprises a second net element and the second collection pocket comprises a third net element; and a first support element disposed between the first collection pocket and the collection element at the first end and a second support element disposed between the second collection pocket and the collection element at the second end.

In some embodiments, the first net element comprises a triangular mesh netting.

In some embodiments, the first net element comprises a hexagonal mesh netting.

In some embodiments, the collection element comprises a fabric lining disposed at outer peripheral edges thereof coupled to the first net element.

In some embodiments, the first and second collection pockets each comprise a fabric lining disposed at outer peripheral edges thereof.

In some embodiments, the collection element comprises a middle portion disposed between the first and second ends; and the middle portion is disposed at a vertically higher position than the first and second ends.

In some embodiments, the first net element comprises a middle portion disposed between the first and second ends; and the middle portion is disposed at a vertically higher position than the first and second ends.

In some embodiments, the first collection pocket comprises stitching at outer peripheral edges thereof.

In some embodiments, the second collection pocket comprises stitching at outer peripheral edges thereof.

In some embodiments, the collection element comprises stitching at outer peripheral edges thereof.

In some embodiments, the first, second and third net elements comprise stitching at outer peripheral edges thereof.

In some embodiments, the first and second support elements each comprise a sleeve and a bracket element.

In some embodiments, each sleeve comprises a cavity having respective length, width and height dimensions greater than that of length, width and height dimensions of each bracket element.

In some embodiments, each bracket element comprises a flexible material.

In some embodiments, each bracket element comprises a U-shape.

In some embodiments, each bracket element comprises a first terminal end coupled to a clamping mechanism and a second terminal end.

In some embodiments, each sleeve comprises a first open end disposed adjacent the clamping mechanism and a second closed end disposed adjacent the second terminal end.

In some embodiments, the first collection pocket is stitched to an entire length of the first support element.

In some embodiments, a table tennis collection system is provided comprising a collection element having a horizontally elongate shape with a first end and an opposing second end, wherein: the collection element comprises a first net element extending from the first end to the second end, the first net element comprises a middle portion disposed between the first and second ends, and the middle portion is disposed at a vertically higher position than the first and second ends; a first collection pocket disposed at the first end and a second collection pocket disposed at the second end, wherein the first collection pocket comprises a second net element and the second collection pocket comprises a third net element; and a first support element disposed between the first collection pocket and the collection element at the first end and a second support element disposed between the second collection pocket and the collection element at the second end.

In some embodiments, a table tennis collection system is provided comprising a collection element having a horizontally elongate shape with a first end and an opposing second end, wherein the collection element comprises a first net element extending from the first end to the second end; a first collection pocket disposed at the first end and a second collection pocket disposed at the second end, wherein the first collection pocket comprises a second net element and the second collection pocket comprises a third net element; a first support element disposed between the first collection pocket and the collection element at the first end and a second support element disposed between the second collection pocket and the collection element at the second end, wherein the first support element comprises a first sleeve and the second support element comprises a second sleeve; and a first bracket element disposed within the first sleeve and a second bracket element disposed within the second sleeve.

Exemplary embodiments of the present invention are illustrated in the accompanying figures. As shown in FIG. 1A, a perspective view of a table tennis collection system 100*a* is provided. The table tennis collection system 100*a* includes a flat playing surface 110 on a horizontal plane. The playing surface 110 may take any suitable form usable for gameplay in table tennis, but is preferably similar to table tennis playing surfaces that are well known in the art. The playing surface 110 includes a central net (not shown).

The playing surface 110 couples to a collection element 140. The collection element 140 comprises a net element 160 attached to a center post 120. The center post 120 may include attachment means for a central net (not shown) that spans across the center of the playing surface, bisecting the table, as is known in the art. Alternatively, the center post 120 may be separate from a central net and attachable to the playing surface independently of the central net.

The net element 160 may be attached to the center post 120 of the collection element 140 and removably attached to the playing surface 110 edge. Attachment of the net element 160 to the playing surface 110 edge may be performed via coupling mechanisms (not shown), such as magnets, hook and loop fasteners, snaps and the like or any combination thereof, which operate to keep the net element 160 of the collection element 140 taut during gameplay. Utilizing a removable attachment via coupling mechanisms allows the removable attachment to act as a breakaway attachment which may prevent an occurrence of injury in the event a player's body part colliding with the collection element 140 or getting caught in the net element 160 during gameplay. The coupling mechanisms may maintain coupling up to a predetermined threshold coupling force such that, upon application of a force greater than the predetermined threshold coupling force, the coupling mechanism may become uncoupled in a breakaway manner.

Figure 1B:
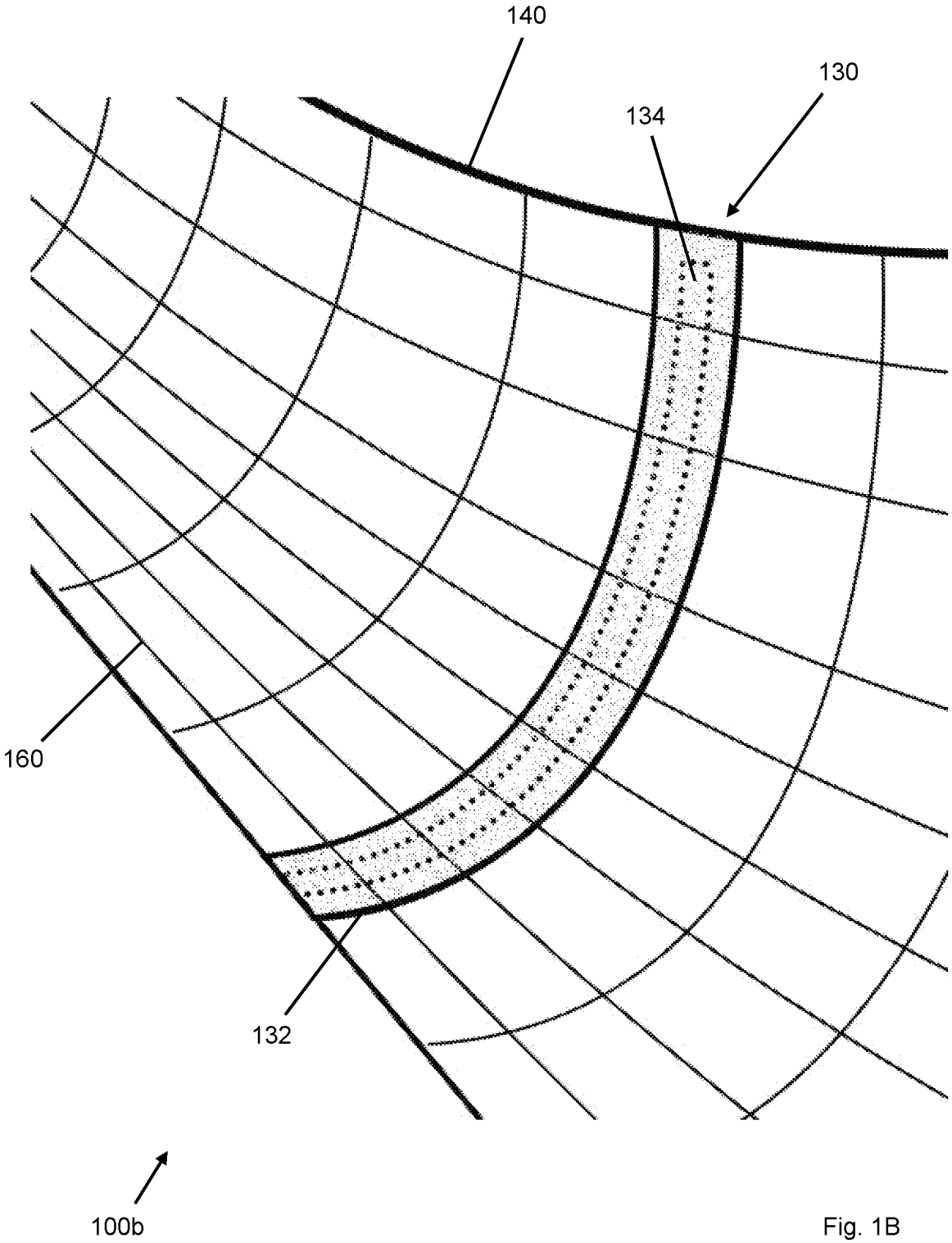
FIG. 1B illustrates a detailed view of a support element of a collection element of a table tennis collection system in accordance with some embodiments of the present invention.
Figure 2A:
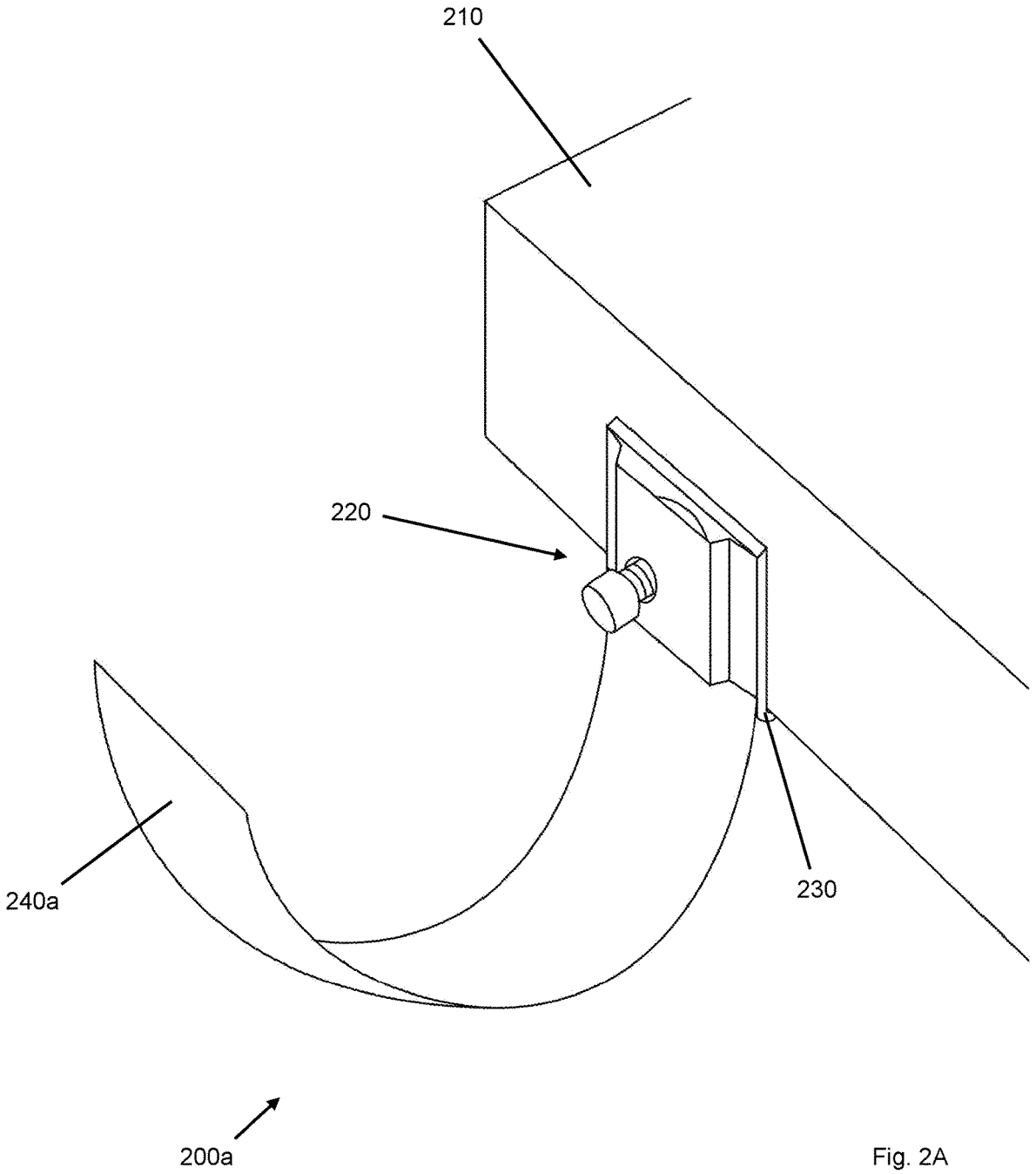
FIG. 2A illustrates a perspective view of a rounded U-shaped bracket element of a table tennis collection system in accordance with some embodiments of the present invention.
Figure 2B:
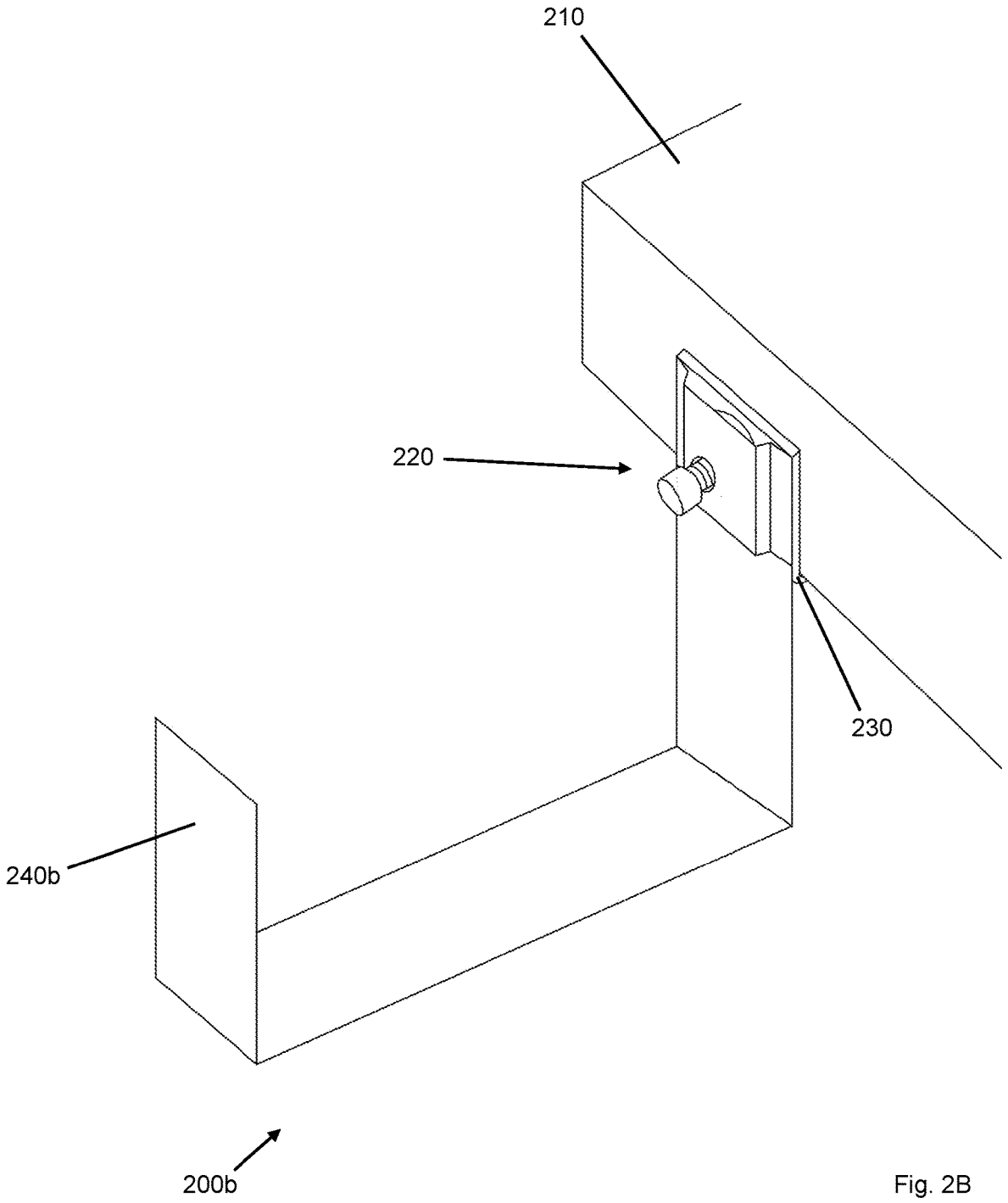
FIG. 2B illustrates a perspective view of a flat U-shaped bracket element of a table tennis collection system in accordance with some embodiments of the present invention.

The collection element 140 may include one or more support elements 130 which each connect to the net element 160 via a sleeve (not shown). The sleeve may accept a bracket element therein as illustrated in FIG. 1B and the bracket element may couple to the playing surface 110 via a clamping element as illustrated in FIGS. 2A-2B. Thereby, the support elements 130 may be coupled to the playing surface 110 via the clamping elements. The bracket elements may be formed of a pliable or deformable material to prevent injury to a player if a player's body part strikes the brackets during gameplay. Further, a pliable or deformable material allows the player to manipulate the bracket element into the desired configuration for optimal compatibility and functionality with the given playing surface 110 and center post 120.

The collection element 140 may further comprise a collection pocket 150 at an end portion of the collection element 140. The collection pocket 150 provides a closed portion at the end portion of the collection element 140 which allows collection of a table tennis ball. The collection element 140 is arranged having the portion near the the center post 120 to be in a vertically higher position than the portion near the collection pocket 150. This difference in height provides a downward slope to the collection element 140 which allows gravity to force the table tennis ball to roll toward the collection pocket 150.

As shown in FIG. 1B, a detailed view of a support element 130 of a collection element 140 of a table tennis collection system 100*b* is provided. The collection element 140 includes a net element 160 which connects to the side edge of a playing surface 110 via bracket elements 134. The bracket elements 134 may be coupled to the playing surface 110 via clamping elements (not shown).

The collection element 140 and the net element 160 may comprise a sleeve 132 fabricated therein. Specifically, the sleeve 132 may be stitched into the net element 160 and between terminal ends of the collection element 140 in the width dimension as illustrated in FIG. 1B. The sleeve 132 may be formed of a flexible or pliable material such as fabric, a deformable plastic and the like or any combination thereof. The sleeve 132 may be fixedly attached to the net element 160 to provide structural support to the net element 160 after insertion of the bracket element 134.

Attachment of the net element 160 to the playing surface 110 is accomplished through use of the sleeve 132 and the bracket element 134. The sleeve 132 includes an internal cavity or pocket which may be formed by sewing, glueing or otherwise attaching fabric or deformable plastic together. At least a portion of the bracket elements 134 may be inserted into the pocket of the sleeve 132 as shown in FIG. 1B.

The bracket elements 134 are formed of a pliable or deformable material, but the bracket elements 134 retain some rigidity to provide structure to the net element 160. When the net element 160 is attached to the bracket elements 134 through use of the sleeve 132, the flexible nature of the sleeve 132 allows it to conform to the shape of the bracket elements 134. Upon insertion of the bracket elements 134 into the pocket of sleeve 132, the sleeve 132 takes on a general U-shaped form. This provides structure to the net element 160 which will be positioned along side edges of the playing surface 110 with a U-shape in order capture table tennis balls that roll or bounce off the playing surface 110 and into the collection element 140.

Figure 1C:
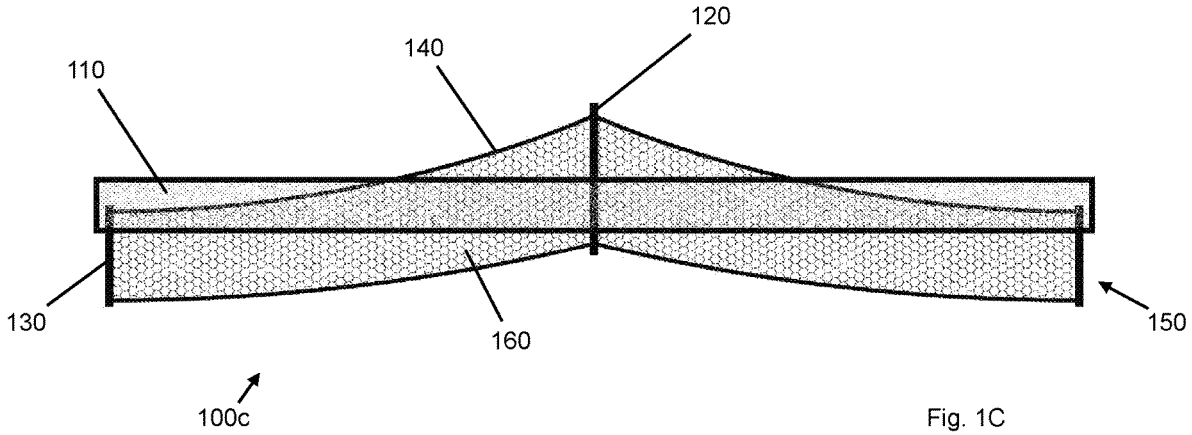
FIG. 1C illustrates an elevational view of a table tennis collection system in accordance with some embodiments of the present invention.

As shown in FIG. 1C, an elevational view of a table tennis collection system 100*c* is provided. The table tennis collection system 100*c* includes a playing surface 110 and a collection element 140. The collection element 140 includes a net element 160, one or more support elements 130, and a collection pocket 150. The net element 160 may be removably coupled to a center post 120 of the playing surface 110. The collection element 140 is positioned at the side of the playing surface 110 in order to retain table tennis balls that roll or bounce off of the playing surface 110.

The collection element 140 may be positioned along the edge of the playing surface 110 and runs the length of the side edge of the playing surface 110. The center post 120 is positioned in the center of the playing surface at a point which bisects the playing surface 110 into two equal halves. The center post 120 may be attached to the playing surface 110 with a clamping device.

The center post 120 is, in part, positioned above the playing surface 110 such that a center portion of the net element 160 that is removably coupled to the center post 120 allows the center portion of the net element 160 to be positioned above the playing surface 110. The support elements 130 at opposite ends of the playing surface 110 are located at a position lower than and/or in line with the playing surface 110 as shown in FIG. 1C.

The net element 160 is attached to the support elements 130 through use of one or more sleeves as described with respect to FIG. 1B. Upon attaching the net element 160 to the center post 120 and the support elements 130, the net element 160 surface is pulled taut and slopes downward from the center portion to the end portions at the support elements 130 at opposite ends of the playing surface 110. A collection pocket 150 is provided at the end portions of the net element 160. The collection pockets 150 are connected to the end portions of the net element 160 and to the support elements 130 at opposite ends of the playing surface 110.

The collection pockets 150 provide a closed end at the end portions of the net element 160 that serve as backstops for table tennis balls rolling down the slope of the collection element 140. Specifically, the net element 160 is positioned with a downward slope to direct a table tennis ball from a point where it is received to an end portion of the net element 160 which may then be stopped by the collection pockets 150. Once the table tennis ball is stopped at the collection pockets 150, a player located proximally to the collection pocket 150 may remove the table tennis ball from the collection pocket 150 and continue gameplay.

Figure 1D:
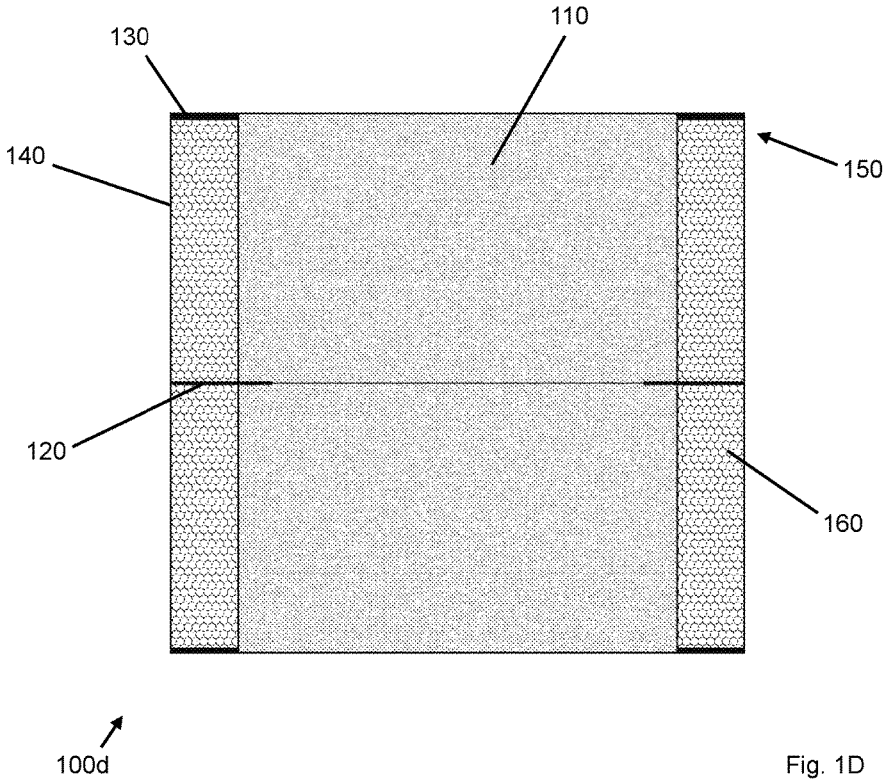
FIG. 1D illustrates a plan view of a table tennis collection system in accordance with some embodiments of the present invention.

As shown in FIG. 1D, a plan view of a table tennis collection system 100*d* is provided. The table tennis collection system 100*d* includes a playing surface 110 that is bisected into two equal halves, separated by a central net. The table tennis collection system 100*d* includes multiple collection elements 140. The collection elements 140 may be positioned on both sides of the playing surface 110. Each collection element 140 includes a center post 120, a net element 160, a plurality of support elements 130 and a plurality of collection pockets 150.

Each collection element 140 is positioned along the side edge of the playing surface 110. The collection element 140 and the net element 160 may extend beyond the edge of the playing surface 110. The net element 160 may not overlap the playing surface 110 so as to not interfere with gameplay during use.

As shown in FIG. 2A, a a perspective view of a rounded U-shaped bracket element 200*a* of a table tennis collection system is provided. The U-shaped bracket 200*a* may comprise a clamping element 220, a bracket element 230 and a rounded support element 240*a* that are collectively coupled to a bottom edge of a playing surface 210. The bracket element 230 includes a clamping element 220 fixedly attached to the playing surface 210. The clamping element 220 may be composed of a rigid material, allowing a secure attachment to be made with the playing surface 210. Further, the rigidity of the clamping element 220 will provide the table tennis collection system 200*a* with greater stability and reduce movement.

The bracket element 230 may be coupled to the support element 240*a*. The support element 240*a* is provided for attachment to the clamping element 220. The support element 240*a* may be formed of a pliable or flexible material allowing the support element 240*a* to remain coupled to the playing surface 210 upon collision with a player's body. The clamping element 220 may include a slot that is sized and configured to receive an end of the support element 240*a*. The clamping element 220 may include an aperture to receive a fastening means to secure the support element 240*a* to the bracket element 230. The support element 240*a* is attached in an orientation with the end portions directed upward which forms a U-shape providing an adequate opening to collect a table tennis ball.

Coupling of the support element 240*a* to the clamping element 220 is provided by a fastening means. The fastening means may be a screw, pin, snap or the like to provide a secure attachment of the support element 240*a* to the clamping element 220. The support element 240*a* may deform or bend on collision, but then the support element 240*a* will return to its original position after the collision.

Alternatively, a clamping element 220 may be provided that comprises any other suitable mechanism including, but not limited to, clamps, posts, springs, magnets, frictional grips and the like, or any combination thereof. One or more clamping elements 220 may be attached to the side edge of the playing surface, one provided for each bracket element 230.

Alternatively, the support element 240*a* may be formed of a material that is deformable. Once positioned in the bracket element 230, the support element 240*a* may be adjusted by bending or deforming to another position. This deforming action allows the shape of the support element 240*a* to be modified. For example, the support element 240*a* may be extended horizontally away from the playing surface 210 to provide a wider surface for collecting a table tennis ball. Additionally, the support element 240*a* may be extended upward providing a taller surface to aid in collecting a table tennis ball. Further still, the support element 240*a* may be extended downward, providing greater clearance of the side edge of the playing surface 210 to ensure the table tennis collection system 200*a* does not interfere with gameplay or with a player's motion. Having a support element 240*a* that deforms may allow the user to change the shape of the net element 160 to provide optimal performance to the collection of table tennis balls or to adjust the net element 160 based on a player's preferences and playing style.

As shown in FIG. 2B, a perspective view of a flat U-shaped bracket element 200*b* of a table tennis collection system is provided. The square-shaped bracket 200*b* may comprise a clamping element 220, a bracket element 230 and a square support element 240*b* that are collectively coupled to a bottom edge of a playing surface 210. The bracket element 230 includes a clamping element 220 fixedly attached to the playing surface 210. The clamping element 220 may be composed of a rigid material, allowing a secure attachment to be made with the playing surface 210. Further, the rigidity of the clamping element 220 will provide the table tennis collection system 200*b* with greater stability and reduce movement.

The bracket element 230 further includes square-shaped portion 240*b* having three sides and an open top portion. The support element 240*b* is provided for attachment to the clamping element 220. The support element 240*b* may be formed of a pliable or flexible material allowing the support element 240*b* to remain coupled to the playing surface 210 upon collision with a player's body. The clamping element 220 may include a slot that is sized and configured to receive an end of the support element 240*b*. The clamping element 220 may include an aperture to receive a fastening means to secure the support element 240*b* to the square-shaped bracket 230. The support element 240*b* is attached in an orientation with the end portions directed upward which forms a square shape with an open top portion.

Coupling of the support element 240*b* to the attachment portion is provided by a fastening means. The fastening means may be a screw, pin, snap or the like to provide a secure attachment of the support element 240*b* to the clamping element 220. The support element 240*b* may deform or bend on collision, but then the support element 240*b* will return to its original position after the collision.

Alternatively, the clamping element 220 may be provided that comprises any other suitable mechanism including, but not limited to, clamps, posts, springs, magnets, frictional grips and the like or any combination thereof. Multiple clamping elements 220 may be attached to the playing surface 210 edge where one is provided for each bracket element 230.

Figure 3A:
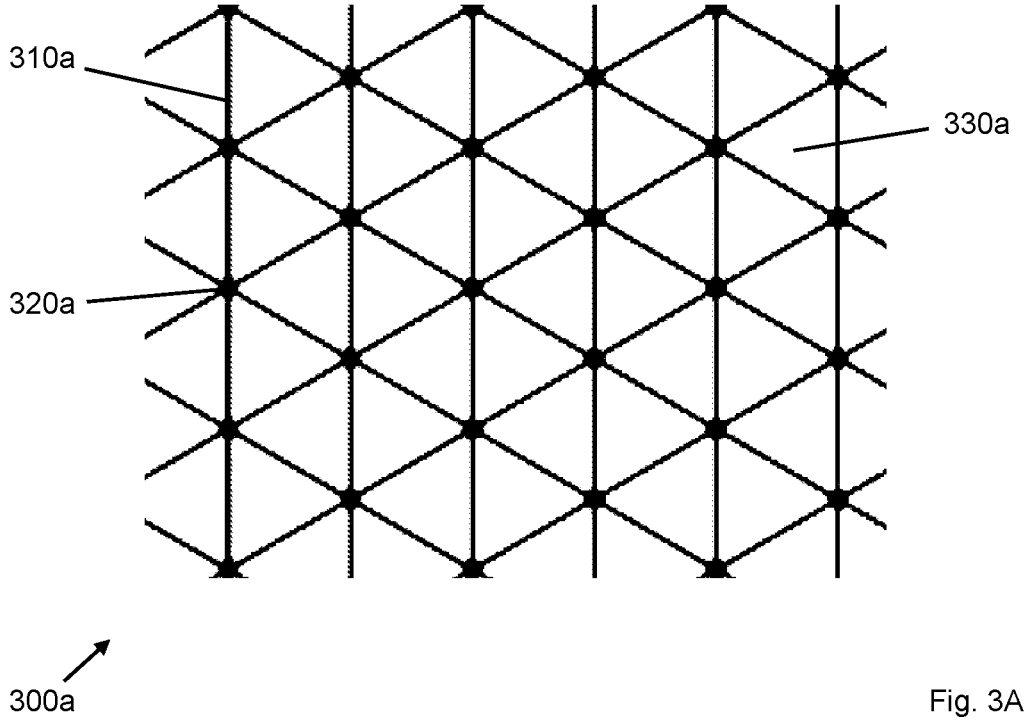
FIG. 3A illustrates a detailed view of a triangular-patterned net element of a table tennis collection system in accordance with some embodiments of the present invention.

As shown in FIG. 3A, a detailed view of a triangular-patterned net element 300*a* of a table tennis collection system is provided. The net element 300*a* may be provided with a generally triangular structural form. This structural form allows the net element 300*a* to retain its shape and withstand the tensile forces required for the net element 300*a* to remain taut. To accomplish this structural stability, the net element 300*a* is manufactured with a pattern of crossing threads or other material suitable for forming a net element.

The net element 300*a* includes a plurality of strings 310*a*. The net element 300*a* may be composed of a plurality of strings 310*a* in each of a vertical orientation, a left facing diagonal orientation, and a right facing diagonal orientation. A connection point 320*a* is formed at each intersection of three overlapping strings 310*a*. The strings 310*a* at each connection point are fused, glued, tied, or otherwise joined into a fixed position. Once the strings 310*a* at a single connection point 320*a* are joined, they are unable to move relative to each other at that connection point 320*a*.

The net element 300*a* has a repeating pattern of connection points 320*a* formed by overlapping strings 310*a*. This repeating pattern of connection points 320*a* and strings 310*a* forms a plurality of triangular cells 330*a* in the space between the strings 310*a* and the connection points 310*a*. The arrangement of strings 310*a* and connection points 320*a* may be selected upon manufacturing to provide an optimal size of the triangular cells 330*a* based on the needed structure of the net element 300*a* and the size of the table tennis ball which will contact the net element 300*a*. Selecting an optimal size of the triangular cells 330*a* may be based on the desired rigidity or flexibility of the net element 300*a* or based on the friction and delivery performance of the table tennis ball when it rolls along the net element 300*a*.

In some embodiments, each of the two-dimensional triangular cells 330*a* may comprise length and width dimension within the range between 1 millimeter and 20 millimeters and, preferably, between 3 millimeters and 10 millimeters. Dimensions below 1 millimeter would not be advantageous as they would be increasingly expensive to produce while providing diminishing returns on ball-rolling performance. Dimensions above 20 millimeters would not be advantageous as they would be approaching the diameter of industry standard table tennis balls and so may capture the ball within the cells 330*a* instead of facilitating its rolling down to the player located at the collection pocket.

Figure 3B:
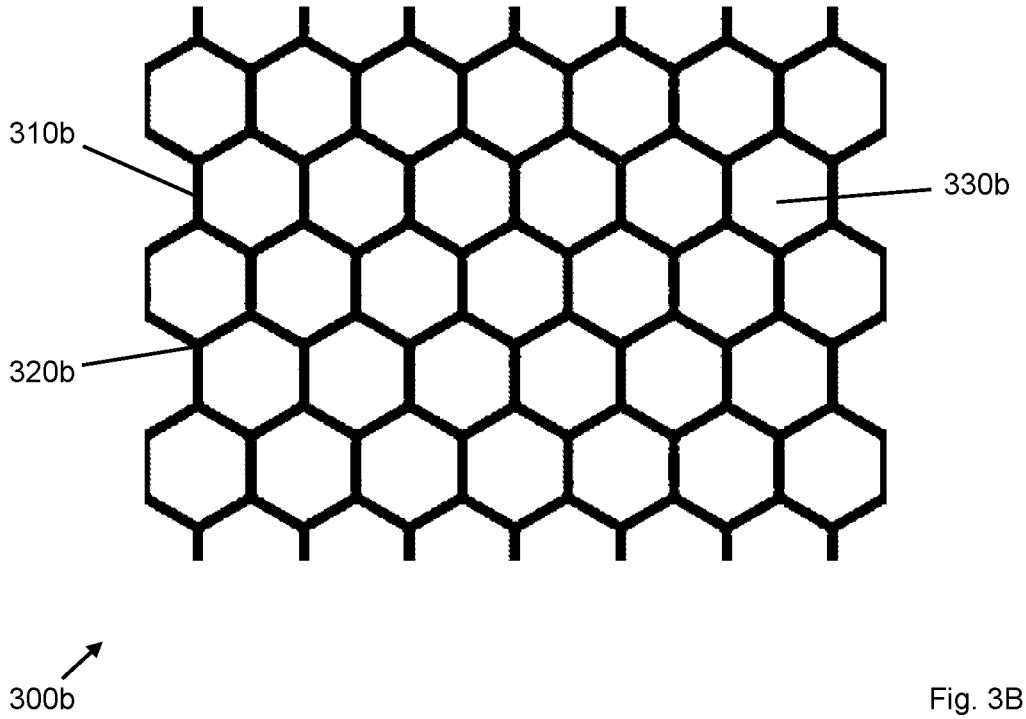
FIG. 3B illustrates a detailed view of a hexagonal-pattern net element of a table tennis collection system in accordance with some embodiments of the present invention.

As shown in FIG. 3B, a detailed view of a hexagonally-patterned net element 300*b* of a table tennis collection system is provided. The net element 300*b* may be provided with a generally hexagonal structural form. This structural form allows the net element 300*b* to retain its shape and withstand the tensile forces required for the net element 300*b* to remain taut. To accomplish this structural stability, the net element 300*b* is manufactured with a pattern of interconnecting material.

The net element 300*b* includes material 310*b*. The material 310*b* may be composed of thread, plastic fiber or filament, or other suitable material well known in the art. The net element 300*b* is formed of material 310*b* in a pattern. This pattern is comprised of side walls 310*b* and joints 320*b*. The pattern is comprise of numbers rows of individual cells 330*b* formed from the side walls 310*b* and joints 320*b*. The cells 330*b* are formed from six side walls 310*b* and having six joints 320*b*, and having a honeycomb shape. The net element 300*b* is constructed from a number of cells 300*b* joined together in a row. Successive rows of cells 330*b* are provided that nest with the row of cells 300*b* above.

The structure provided by these cells 330*b* give the net element 300*b* a strong support to provide a good collecting surface for a table tennis ball. The arrangement of side walls 310*b* and joints 320*b* may be selected upon manufacturing to provide and optimal size of the hexagonal shape for the cells 330*b* based on the needed structure of the net element 300*b* and the size of the table tennis ball which will contact the net element 300*b*. Selecting an optimal size of the cells 330*b* may be based on the desired rigidity or flexibility of the net element 300*b* or based on the friction and delivery performance of the table tennis ball when it rolls along the net element 300*b*.

In some embodiments, each of the two-dimensional hexagonal cells 330*b* may comprise length and width dimension within the range between 1 millimeter and 20 millimeters and, preferably, between 3 millimeters and 10 millimeters. Dimensions below 1 millimeter would not be advantageous as they would be increasingly expensive to produce while providing diminishing returns on ball-rolling performance. Dimensions above 20 millimeters would not be advantageous as they would be approaching the diameter of industry standard table tennis balls and so may capture the ball within the cells 330*b* instead of facilitating its rolling down to the player located at the collection pocket.

Figure 4:
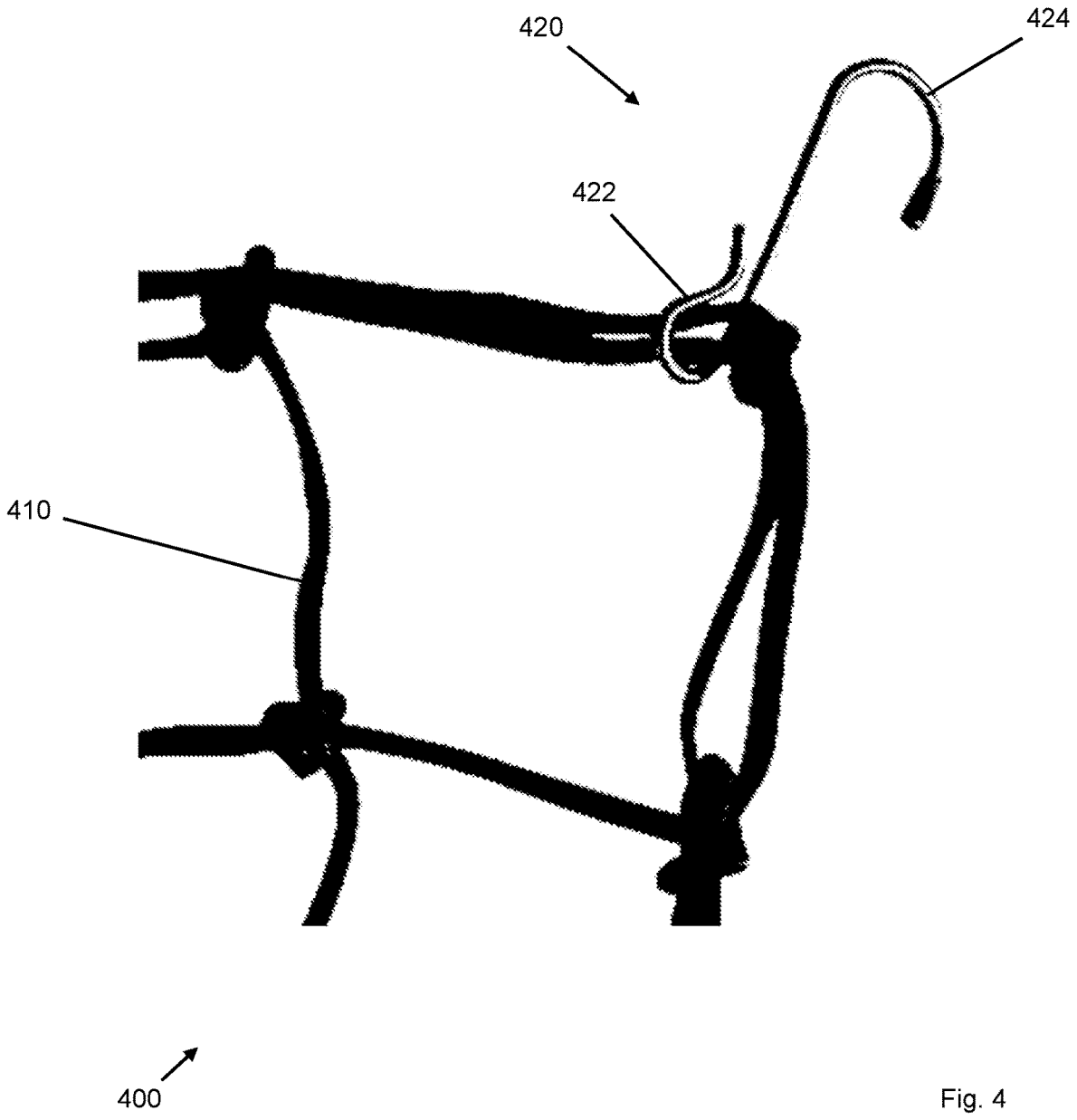
FIG. 4 illustrates a detailed view of a coupling mechanism of a net element of a table tennis collection system in accordance with some embodiments of the present invention.

As shown in FIG. 4, a detailed view of an attachment mechanism 420 of a net element 410 of a table tennis collection system is provided. The net element 410 is shown comprised of string or other suitable, flexible material. The construction of the net element may take on any suitable shape or construction, as is well known in the art or as previously disclosed above. The net element is provided with an attachment mechanism 420. This attachment mechanism 420 may be used to attach the net element 410 corner to a center post or to a point along the playing surface edge (not shown).

The attachment mechanism 420 may be in the form of a hook. A securing loop 422 is provided to engage the outer corner of the net element. The securing loop 422 is a semi-closed hook that allow the string of the outer corner to pass through an open portion of the semi-closed hook. The string located at the outer corner is retained within the securing loop 422 when an outward pulling force is placed on the attachment mechanism 420.

Further, the attachment mechanism 420 includes a hook 424. The hook 424 may be an open hook configured to engage a center post or a point on the playing surface edge. The use of a hook attachment mechanism 420 allows the net element to be removably attached to the center post and the playing surface. This allows for ease of removal when the table tennis collection system is not in use.

Figure 5A:
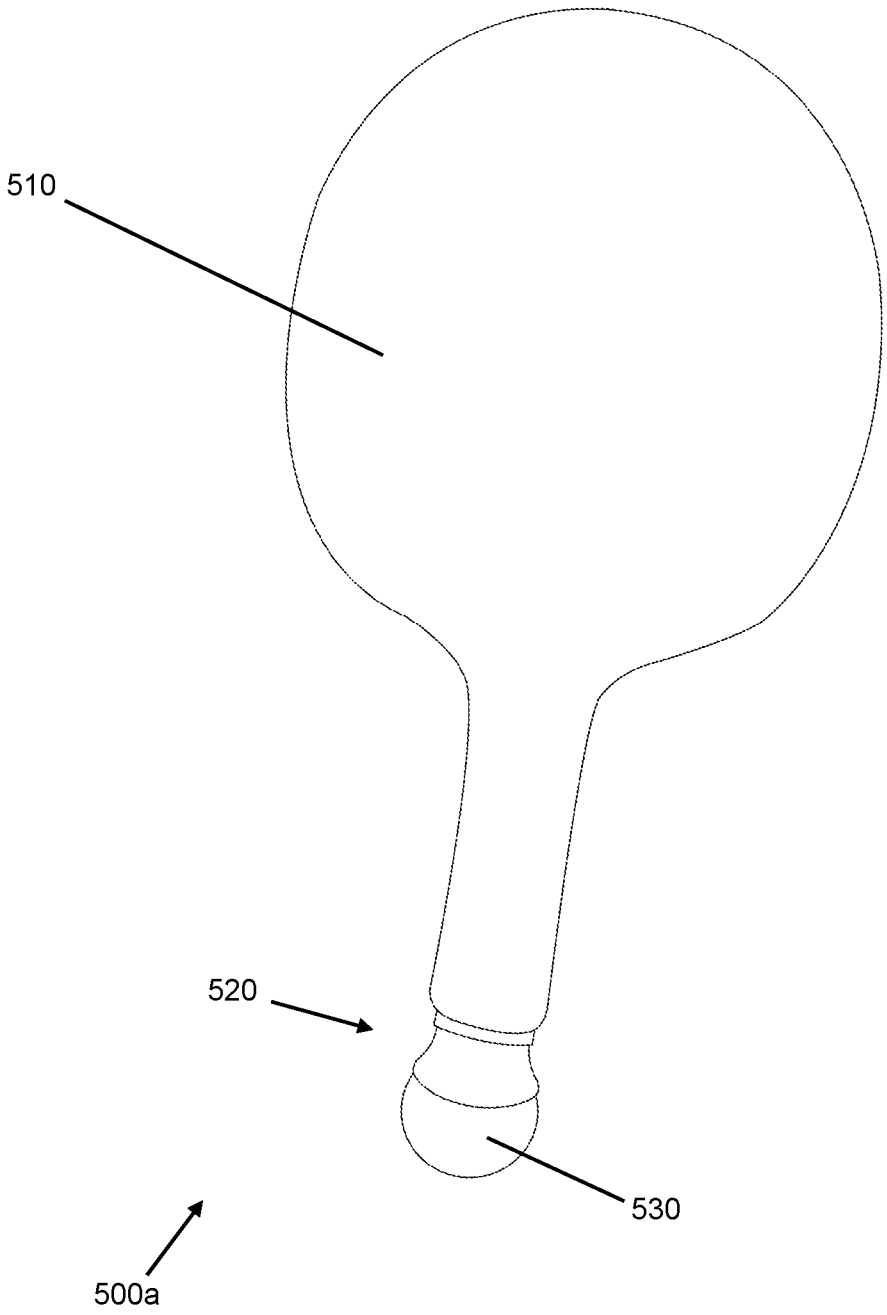
FIG. 5A illustrates an overview of a table tennis paddle system and handle attachment mechanism of a table tennis collection system in accordance with some embodiments of the present invention.

As shown in FIG. 5A, a table tennis paddle system 500*a* and handle attachment mechanism 520 of a table tennis collection system is provided. A table tennis paddle 500*a* includes a front face 510 and a handle attachment mechanism 520. The table tennis paddle 500*a* and handle attachment mechanism 520 provide the player a means to pick up a table tennis ball from the ground with a reduced need of bending over which thereby reduces the physical strain on the player.

The handle attachment mechanism 520 is positioned at the distal end of a handle of the table tennis paddle 500*a*. One side of the handle attachment mechanism 520 is configured for attachment to the handle of the table tennis paddle 500*a* while the opposite side of the handle attachment mechanism 520 is configured to hold a table tennis ball 530. The handle attachment mechanism 520 may hold a table tennis ball 530 by use of suction, friction, adhesive, or any other suitable means.

The handle attachment mechanism 520 may have a concave shape configured to closely match the shape of a table tennis ball 530. When a friction fit is used to grab the table tennis ball 530, the concave shape of the handle attachment mechanism 520 may be slightly undersized to provide a secure friction fit. Alternatively, the concave shape of the handle attachment mechanism 520 may be provided with a textured surface or a surface that deforms and grabs, for example a soft rubber or silicon, to aid in grabbing the table tennis ball 530.

Alternatively, the handle attachment mechanism 520 may utilize suction to grab and hold the table tennis ball 530. Suction may be achieved by any suitable means known in the art including, but not limited to, a deformable soft material that may be squeezed prior to attachment to the table tennis ball 530, which provides suction upon attachment, an evacuable chamber that forms a seal around the table tennis ball 530 that may have air removed through a small bulb pump and valve formed in the handle, or any other suitable means.

Further, the handle attachment mechanism 520 may utilize an adhesive tab to grab and hold the table tennis ball 530. The handle attachment mechanism 520 may be provided with a planar double-sided adhesive tab that may comprise a plurality of stacked adhesive layers. When the adhesive tab is pressed against a table tennis ball 530, the ball will stick to the adhesive tab. If the adhesive tab starts to lose its adhesiveness due to dust, moisture, etc. the top layer in the plurality of stacked adhesive layers may be removed, which reveals a fresh adhesive layer.

The handle attachment mechanism 520 may be used together with the table tennis paddle 500*a* to provide the player with an easy means of picking up a ball that may have fallen from the table tennis playing surface. The table tennis paddle 500*a* with the handle attachment mechanism 520 may operate as an extension of the player's arm. This allows the player to pick up a stray ball without have to reach down as far.

Figure 5B:
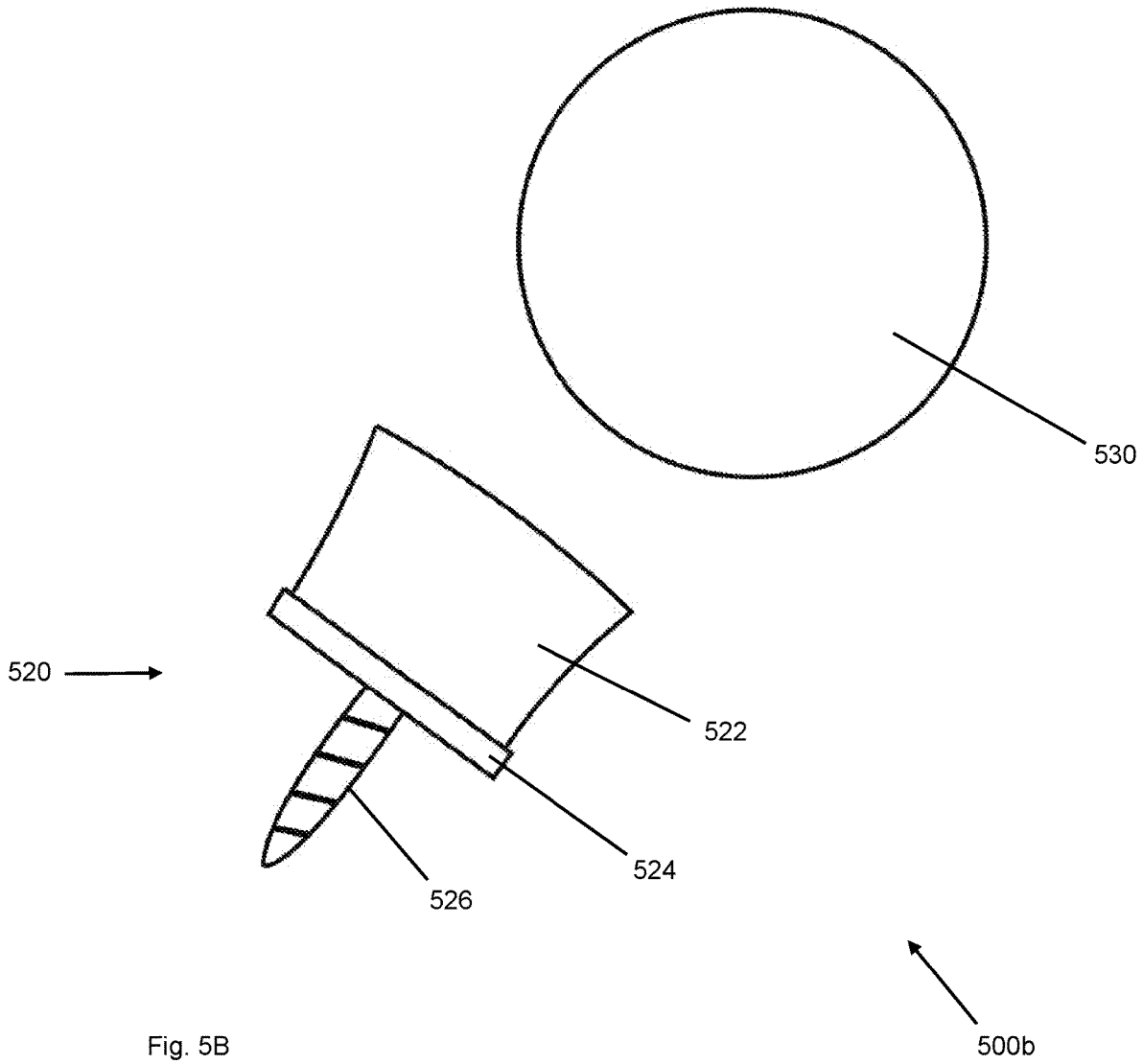
FIG. 5B illustrates a detailed view of a handle attachment system with a ball capture element of a table tennis collection system in accordance with some embodiments of the present invention.

As shown in FIG. 5B, a detailed view of a handle attachment system 500*b* with a ball capture element 522 of a table tennis collection system is provided. A paddle handle attachment 520 is provided and comprises a rigid disk 524, a ball capture element 522, and an attachment mechanism 526. The attachment mechanism 526 and the ball capture element 522 are on opposite sides of the rigid disk 524. The ball capture element 522 is used to contact the table tennis ball 530 and may be any means disclosed in reference to FIG. 5*a*. The attachment mechanism 526 is provided to attach the paddle handle attachment 520 to the handle of a table tennis paddle. The attachment mechanism 526 may be any suitable mechanism including, but not limited to, a screw, a snap, hook and loop fasteners, staple, adhesive and the like or any combination thereof. The attachment mechanism 526 may be used to permanently or removably attach the paddle handle attachment 520 to the hand of a table tennis paddle.

With further reference to FIGS. 1-5*b*, the above described table tennis collection system is designed to provide players with an enhanced gameplay experience. The collection elements described are used to collect table tennis balls that would have otherwise fallen off the table from an errant strike or a missed return and would then need to be chased down. Having this system in place can serve to make a table tennis match more enjoyable and efficient. Time is not wasted finding balls that fall off the table, and gameplay is not interrupted, allowing a continuous flow of action. This improves gameplay for the players, as they are not distracted by interruptions, and improves the experience for spectators who are able to watch more continuous action. Further, by prevent table tennis balls from falling over the edge of the playing surface and onto the floor, damage to the table tennis balls may be reduced from a player stepping on the ball.

Further, incorporating the table tennis collection system would benefit schools and competitions, or would benefit any venue where a large number of matches would be played. The time taken for an individual match may be reduced which allows competitions to stay on schedule and potentially have a larger number of players compete in the allotted time.

With further reference to FIGS. 1-5*b*, the collection elements may take any suitable form including, but not limited to, netting, mesh, cushioning and the like, or any combination thereof. The collection elements may have a general concave shape with an open upward portion. This allows the collection elements to retain table tennis balls that have fallen off the playing surface. The collection element may have have a U-shape designed to channel the ball. The collection element is positioned along the sides of the playing surface to collect table tennis balls once they roll off the edge of the playing surface. The positioning of the collection element is designed to maximize coverage in areas of the playing surface where the player is typically not positioned and cannot easily reach.

Additionally, the slope of the collection element provides a sloping surface to the net element which allows the ball to be collected and delivered to an end of the collection element at a collection pocket near a player. This allows the player to retrieve the ball without moving from the traditional playing position at the ends of the playing surface. Since the player does not need to move out of position to recover the ball, significant time may be saved between plays.

Additionally, the collection element may be connected to the U-shaped brackets via hook and loop fastener tabs or other connection means disclosed above. The table tennis collection system is design to enhance safety of the players and longevity of the system. Through use of flexible or deformable materials for some of the components of the table tennis collection system, the possibility of injury to a player from a collision with a bracket is reduced. Likewise, the possibility of damage to the table tennis collection system from a collision with a player or a player catching a portion of the net element is greatly reduced.

With further reference to FIGS. 1-5*b*, the table tennis collection system is further designed with multiple components that are removably attachable from each other. This provides the benefit of ease of replacing damaged parts. Further, having removably attachable components allows the system to be disassembled when not in use which allows for ease of storing the system. The table tennis collection system is easily removable which allows players to choose whether they want to play with the system attached or to play with the system removed.

With further reference to FIGS. 1-5*b*, the paddle handle attachment may be removably attached to the handle end of a table tennis paddle. The paddle handle attachment includes a ball capture element which allows the player to recover the ball without bending over as far. The ball capture element may be sized and shaped according to the industry standard dimensions of a table tennis ball.

With further reference to FIGS. 1-5*b*, the net element may be manufactured from a material taking any suitable form including, but not limited to, netting, mesh, cushioning, polymer laminate and the like or any combination thereof. The structure of the net element and the pattern used in constructing the netting may be any suitable form including, but not limited to, triangular, hexagonal, square and the like or any combination thereof.

In some embodiments of FIGS. 1-5*b*, the table tennis collection system may comprise a collection element having an elongate shape in the horizontal dimension such that the collection element extends along the majority or entirety of the side surface of the table tennis playing surface. Further, the collection element, a first collection pocket and a second collection pocket may each comprise their own portions of netting that may be separated into a first net element, a second net element and a third net element. Each of these net elements may be separated by a first and second support element that are disposed between the collection pockets and the collection element, respectively.

Further, each of the collection element, the first collection pocket and the second collection pocket may comprise one or more continuous or distinct fabric linings disposed at outer peripheral edges thereof. Similarly, these fabric linings may be disposed at outer peripheral edges of the first, second and third net elements. The fabric linings may be utilized as a fabric medium for receiving stitching that couples the respective net elements to the collection element, the first collection pocket and the second collection pocket during manufacturing of the table tennis collection system. Upon manufacturing, a middle portion of the first net element of the collection element may be disposed at a vertically higher position than the opposing first and second terminal ends of the collection element.

Additionally, each of the support elements of the table tennis collection system may comprise a sleeve and a bracket element such that each bracket element may be disposed within a cavity contained within each sleeve. The cavity should be fabricated to have dimensions similar to that of the bracket element to allow ease of coverage of the sleeve over the bracket element. In other words, each sleeve may comprise a cavity having respective length, width and height dimensions greater than that of the length, width and height dimensions of each bracket element. Further, each of the bracket elements may be fabricated from a flexible material to allow iterative repositioning of the bracket element to better suit the needs of the player on their given table tennis playing surface.

Moreover, each of the bracket elements may comprise a general U-shape that has a first terminal end coupled to a clamping mechanism and a second terminal end disposed into the farthest extent of the sleeve cavity. The sleeve cavity may comprise a first open end disposed adjacent the clamping mechanism and a second closed end disposed adjacent the second terminal end of the bracket element. Further, in order for the collection pockets to function properly as backstops, each of the collection pockets may need to be coupled to the clamping mechanism or each of the collection pockets may need to be stitched to an entire length of the sleeve of each support element.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All features disclosed in the specification, claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

Throughout this disclosure, the phrase 'modularly coupled' and similar terms and phrases are intended to convey that any element of a given class of elements may be coupled to another given element and vice versa with equal effect. For example, any extension cord of a plurality of extension cords may be modularly coupled to another extension cord and vice versa with equal effect. Further, throughout this disclosure, the phrase 'removably coupled' and similar terms and phrases are intended to convey that a given element may be iteratively coupled to and removed from another given element as desired. For example, a male plug of a first extension cord may be removably coupled to a female plug of a second extension cord as desired.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "coupled" or "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A table tennis collection system, comprising:

a collection element having a horizontally elongate shape with a first end and an opposing second end, wherein the collection element comprises a first net element extending from the first end to the second end;

a first collection pocket disposed at the first end and a second collection pocket disposed at the second end, wherein the first collection pocket comprises a second net element and the second collection pocket comprises a third net element; and a first support element disposed between the first collection pocket and the collection element at the first end and a second support element disposed between the second collection pocket and the collection element at the second wherein the first and second support elements each comprise a sleeve and a bracket element.

2. The table tennis collection system of claim 1, wherein the first net element comprises a triangular mesh netting.

3. The table tennis collection system of claim 1, wherein the first net element comprises a hexagonal mesh netting.

4. The table tennis collection system of claim 1, wherein the collection element comprises a fabric lining disposed at outer peripheral edges thereof coupled to the first net element.

5. The table tennis collection system of claim 1, wherein the first and second collection pockets each comprise a fabric lining disposed at outer peripheral edges thereof.

6. The table tennis collection system of claim 1, wherein:

the collection element comprises a middle portion disposed between the first and second ends; and the middle portion is disposed at a vertically higher position than the first and second ends.

7. The table tennis collection system of claim 1, wherein:

the first net element comprises a middle portion disposed between the first and second ends; and the middle portion is disposed at a vertically higher position than the first and second ends.

8. The table tennis collection system of claim 1, wherein the first collection pocket comprises stitching at outer peripheral edges thereof.

9. The table tennis collection system of claim 1, wherein the second collection pocket comprises stitching at outer peripheral edges thereof.

10. The table tennis collection system of claim 1, wherein the collection element comprises stitching at outer peripheral edges thereof.

11. The table tennis collection system of claim 1, wherein the first, second and third net elements comprise stitching at outer peripheral edges thereof.

12. The table tennis collection system of claim 1, wherein each sleeve comprises a cavity having respective length, width and height dimensions greater than that of length, width and height dimensions of each bracket element.

13. The table tennis collection of claim 1, wherein each bracket element comprises a flexible material.

14. The table tennis collection system of claim 1, wherein each bracket element comprises a U-shape.

15. The table tennis collection system of claim 1, wherein each bracket element comprises a first terminal end coupled to a clamping mechanism and a second terminal end.

16. The table tennis collection system of claim 15, wherein each sleeve comprises a first open end disposed adjacent the clamping mechanism and a second closed end disposed adjacent the second terminal end.

17. The table tennis collection system of claim 1, wherein the first collection pocket is stitched to an entire length of the first support element.

18. A table tennis collection system, comprising:

a collection element having a horizontally elongate shape with a first end and an opposing second end, wherein the collection element comprises a first net element extending from the first end to the second end;

a first collection pocket disposed at the first end and a second collection pocket disposed at the second end, wherein the first collection pocket comprises a second net element and the second collection pocket comprises a third net element;

a first support element disposed between the first collection pocket and the collection element at the first end and a second support element disposed between the second collection pocket and the collection element at the second end, wherein the first support element comprises a first sleeve and the second support element comprises a second sleeve; and a first bracket element disposed within the first sleeve and a second bracket element disposed within the second sleeve.

* * * * *